US007458396B2

(12) United States Patent
Kremer

(10) Patent No.: US 7,458,396 B2
(45) Date of Patent: Dec. 2, 2008

(54) METHOD AND DEVICE FOR FLOW SWITCHOVER

(75) Inventor: Eugen Kremer, Buehl (DE)

(73) Assignee: Luk Lamellen und Kupplungsbau Beteiligungs KG, Buehl (DE)

( * ) Notice: Subject to any disclaimer, the term of this patent is extended or adjusted under 35 U.S.C. 154(b) by 436 days.

(21) Appl. No.: 10/919,941

(22) Filed: Aug. 17, 2004

(65) Prior Publication Data

US 2005/0039803 A1 Feb. 24, 2005

(30) Foreign Application Priority Data

Aug. 23, 2003 (DE) ..... 103 38 881

(51) Int. Cl.
*F15B 13/042* (2006.01)

(52) U.S. Cl. ..... 137/625.66; 251/50

(58) Field of Classification Search ..... 251/47, 251/48, 50; 137/625.6, 625.66
See application file for complete search history.

(56) References Cited

U.S. PATENT DOCUMENTS 3,107,693 A * 10/1963 Puster et al. ..... 137/625.66
3,267,965 A * 8/1966 Kroffke ..... 137/625.66
3,548,879 A * 12/1970 Werner ..... 137/625.66
3,610,285 A * 10/1971 Passaggio ..... 137/625.66
3,955,597 A * 5/1976 Oneyama et al. ..... 137/625.66
4,187,884 A * 2/1980 Loveless ..... 137/625.66
4,649,957 A * 3/1987 Quinn ..... 137/625.66
4,763,691 A 8/1988 Hahmann ..... 137/596.14

FOREIGN PATENT DOCUMENTS

DE 36 29 479 7/1987
DE 37 23 672 1/1989
EP 1 279 870 1/2003
JP 56055762 A * 5/1981 ..... 137/625.66

* cited by examiner

*Primary Examiner*—John Rivell
(74) *Attorney, Agent, or Firm*—Davidson, Davidson & Kappal, LLC

(57) ABSTRACT

A method and a device for flow switchover are described, the time to switch over the fluid being shortened. This is accomplished by a three-way valve, which may be provided with additional connections to the pump and the slider is designed accordingly. With the help of the connections and additional pressure storage in the slider, a corresponding pressure force is stored, which is used during the switchover process, when the connections to the fluid system and to the reservoir are closed, to superimpose over the motion of the slider, with time delay, an additional motion, which is carried out by the sliding ring positioned on the slider.

18 Claims, 3 Drawing Sheets

METHOD AND DEVICE FOR FLOW SWITCHOVER

This claims the benefit of German Patent Application No. 103 38 881.8, filed Aug. 23, 2003 and hereby incorporated by reference herein.

BACKGROUND INFORMATION

The present invention relates to a method and a device for rapid switchover of a liquid or gaseous medium in a hydraulic or pneumatic line via a pump dependent on the pilot pressure into either a reservoir or into the hydraulic or pneumatic line using a switchover valve. A flow of oil, for example in a hydraulic line, is controlled primarily by at least one pump, the direction and flow rate being determined by appropriately pilot-operated valves situated in the hydraulic line. A balancing of the hydraulic volume is achieved using a reservoir, so that corresponding valves or valve arrangements are provided in order to implement a switchover of the flow from the pump either into the hydraulic line or into the reservoir.

Hence it is usual, for example, to utilize a flow check valve with a parallel restriction line, an appropriately designed throttle insert operating in this restriction line as a volume regulator. In addition, a plurality of valves having different functions, for example a flow check function and a pressure limiting valve function, may be coupled together like a pilot-controlled pressure regulating valve with a flow check valve. Here the spring chamber of the pressure regulating piston is connected with a pressure or pump connection through an additional throttle bore in the pressure regulating piston itself. If the present static pressure rises above the setting of the pressure valve, the latter is opened and lets hydraulic fluid drain off to the reservoir. This drainage creates a pressure drop in the spring chamber of the pressure regulating piston, thereby canceling the closing force of the spring, and the pressure regulating piston of the flow check valve opens the way to the reservoir.

However, this approach requires a number of individual valves, which is both technically complex and requires a corresponding amount of space.

A more elegant approach for flow switchover or for controlling the pressure medium lines is described in German Patent No. 37 23 672 C2, which implements the combination of the functions of a plurality of valves technically in one valve unit. In this context, a valve is positioned between two valve body connections. The body of the valve is equipped with two spring-loaded slider-type closing pieces, which may be slid toward each other in the valve bore. At the same time, the closing piece guided in a bore in the valve body works together with a valve seat which is fixed in the body. The two spring chambers of the closing pieces are connected with each other. The first closing piece, operating as a valve slide, serves to control at least one control connection, which is connected to a pressure limiting valve. If the valve slide is subjected to a pressure that is greater than the two spring forces in the spring chamber, the valve slide rises from its fixed valve seat in the body and closes the control connection. The other closing piece operates as a pressure regulating piston and is connected with the additional connections on the housing, which are released or opened accordingly during this procedure.

This flow switchover process requires a certain amount of time, however. Thus for a certain time during the switchover the valve slide covers a defined area in the valve body, which must be technically defined, so that the hydraulic line is not able to be connected directly with the reservoir. In the phase in which the valve slide is covering the connections in the body to the hydraulic line and to the pump, the pressure which otherwise builds up upstream from the pump is limited by the pressure limiting valve, which is located between the hydraulic line and the pump.

The use of a flow check valve instead of a pressure limiting valve is also known. However, when a flow check valve is used, there is no guarantee that it will function reliably. If the pilot pressure rises, it opens. If the pilot pressure drops, it responds with a time delay, and in the meantime oil may flow into the hydraulic line and the reservoir.

SUMMARY OF THE INVENTION

An object of the present invention is to switch the fluid from a pump into different line connections as a function of the pilot pressure in such a way that the time this requires is shortened and the switchover may be realized by just one valve, and at the same time the size of the valve undergoes only an insignificant change.

According to the present invention, the slider has a first slider element and a second slider element, which are advanced or accelerated independently of each other at least during a time interval of the switchover process. This acceleration shortens the switchover process, in order to dissipate the pressure increase that occurs upstream from the pump during the switchover as quickly as possible, which among other things may lengthen the life of the pump.

It may be advantageous here to have the fluid switchover from a pump either into a fluid line or into a reservoir take place using a pilot-pressure-dependent three-way valve, without having to utilize an additional flow check valve.

In an advantageous manner, an additional motion may be superimposed over the axial motion of the slider in the valve, producing a resultant motion which is the result of the addition of forces in the same and opposing directions, these forces acting on the slider simultaneously or with a time delay during the switchover process.

It may be particularly advantageous here to store a defined quantity of oil in the slider, which may be directed in the predetermined direction during the switchover process.

To implement these processes, it may be particularly advantageous that a pump is connected either to a fluid line or to a reservoir by a pilot-pressure-dependent three-way valve which contains a two-part slider having a first slider element and a second slider element, and that the body of the valve has additional connections to the pump which connect to the existing connections in the axial direction and are spaced apart both from the latter and from each other.

In an additional advantageous embodiment of the present invention, the thickness of the wall of the valve body may decrease in a stepped manner after the second pump connection in the direction of the pressure spring, and may remain the same for the remaining part of the valve body. The radial ring surface that occurs at the shoulder may form at the same time the stop surface for the slider guided in the body.

It may also be advantageous for the slider to have an indentation before its end on the pressure spring side, which in two steps of appropriate width in the direction of this end again reaches the diameter of the slider, and with an additional outermost step matches the inside diameter of the body. This stepped design of the indentation has the advantage that simultaneously defined stops may be implemented in this way. Therefore, the design of the body offers the possibility for the radial ring surface produced by the outermost step of the slider to form the return surface, and, using the stop surface, to limit the travel of the pressure spring in an advantageous manner.

In an advantageous manner, the slider may be provided in the radial direction with a centered through bore. The diameter of this bore should be selected to be the same as the diameter of the two additional pump connections, in order to be able to create a reliable connection between pump and slider and not produce any pressure loss.

It also may be advantageous to select the distance from the through bore to the pressure surface so that at the moment when the slot of the slider is in the coverage area the slider is joined via this through bore to the additional left pump connection.

Provided in an additional advantageous embodiment of the present invention may be a blind hole centered on the axis in the slider, extending from its end on the pressure spring side and reaching into the through bore, in which a pin is guided.

The bores provided in the slider, which are connected to a line at right angles, act together with the stepped indentation to receive a defined volume of oil, via which movements of parts may be carried out if necessary through application or release of pressure. As a result, the pin present in the blind hole is moved within the blind hole either in the direction of the body wall or in the direction of the bore. At the same time it may be advantageous for it to be a certain length, in order to also be able to center the slider in the housing.

Another advantageous embodiment of the present invention provides that depending on the function the width of the innermost step of the indentation may be defined by the distance from the outer wall of the diameter of the through bore to the shoulder of the adjoining second step, and the width of the second step results from the sum of the diameters of the two additional pump connections and their distance from each other.

It also may be advantageous that the width of the second step of the indentation adjoins that of the innermost one and goes beyond the stepped reduction of the wall thickness of the valve body. That forms an additional pressure chamber, which also influences the axial movement of the slider.

It also may be advantageous that on the innermost step of the indentation there is a sliding ring, which is able to move axially on the former. That divides the mass of the slider into two sub-masses. The operatively connected masses may thus be subjected to forces of different magnitudes, whose directions may also be different.

It also may be advantageous that the outside diameter of the sliding ring corresponds to the inside diameter of the body, i.e., that the two are in contact with each other. This ensures that the particular additional pump connection may be closed and also that the pressure which has built up in the second pressure chamber may not be dissipated without control.

In an advantageous refinement of the present invention, the width of the sliding ring may be derived from the difference between the width of the innermost step and the diameter of the connection. This ensures that an additional pump connection is always open when the sliding ring is in one of its end positions on the innermost step.

An additional advantage may be that the surface roughness of the outside and inside diameters of the sliding rings are different. It may be especially advantageous if the roughness of the surface of the outside diameter of the sliding ring is greater than that of the inside diameter. This results in a static friction between the surface of the sliding ring and the surface of the inside diameter of the valve body, which is utilized to achieve a delay when the direction of movement of the slider is reversed.

In addition, it may be advantageous if the slider and sliding ring are made of metallic material. However, they may also be made of a non-metallic or plastic material. The two components may also be made of different materials. This depends on the particular application.

BRIEF DESCRIPTION OF THE DRAWINGS

The device is described in greater detail on the basis of an exemplary embodiment, the embodiments referring to a hydraulic line, in which.

DETAILED DESCRIPTION

Figure 1:
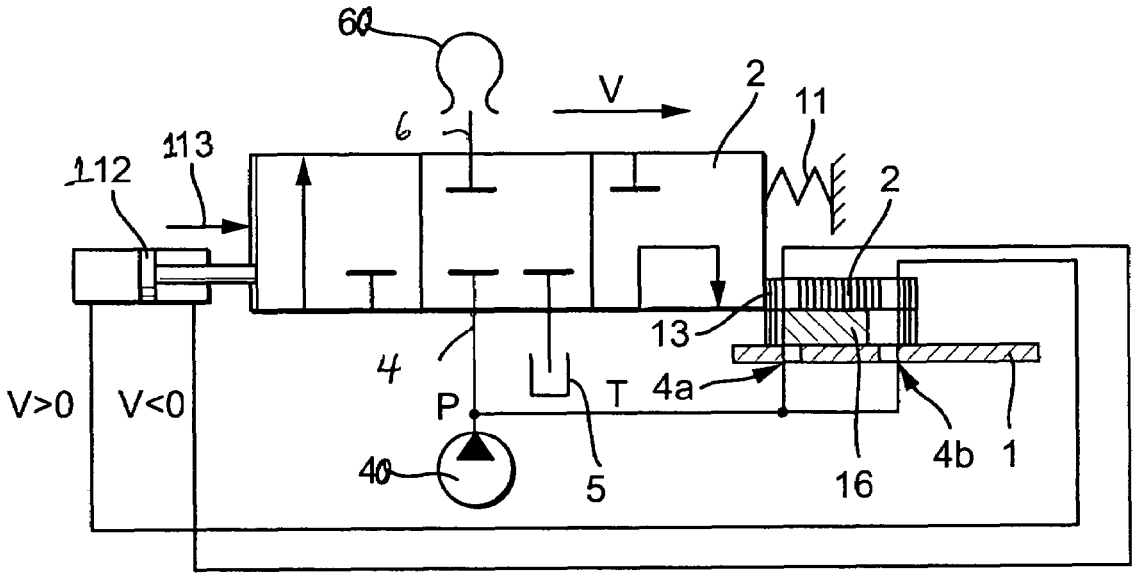
FIG. 1 shows the principle of the approach according to the present invention in a hydraulic line.

FIG. 1 shows in principle the configuration and the operating mode of the present invention in a hydraulic line. A switchover valve in the form of a three-way valve, which is connected to a module via two connections, is subjected by a controller to a pilot pressure 113 exerted by a piston 112. This moves the closing member or slider 2 present in the valve in direction V back and forth in such a way that the desired lines are connected with each other.

Figure 2:
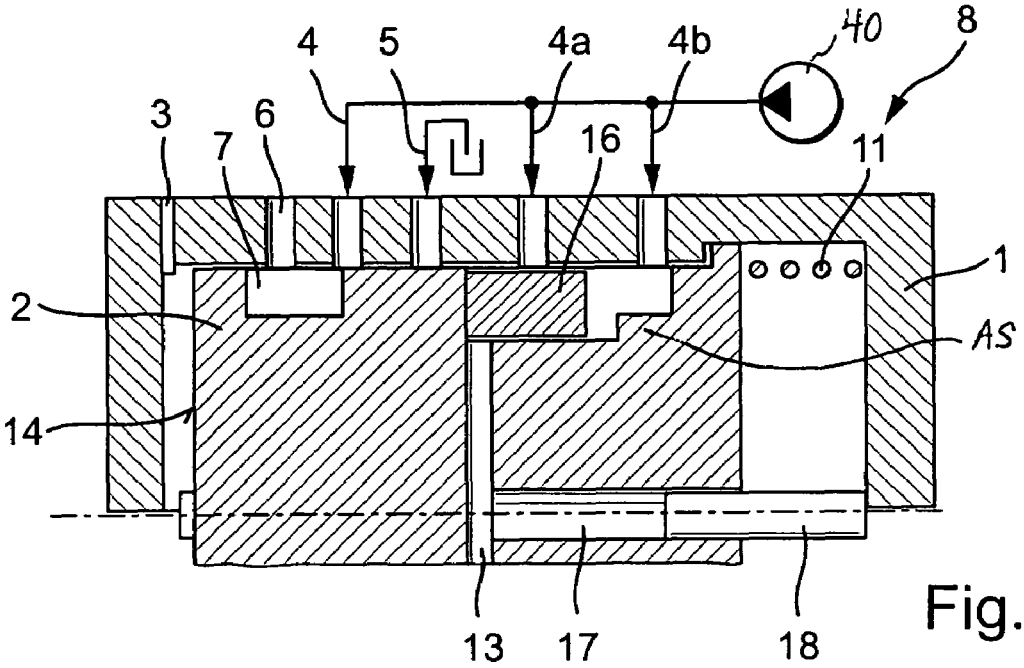
FIGS. 2, 3, 4 and 5 show the operation of the switchover valve according to the present invention under different pilot pressures.
Figure 3:
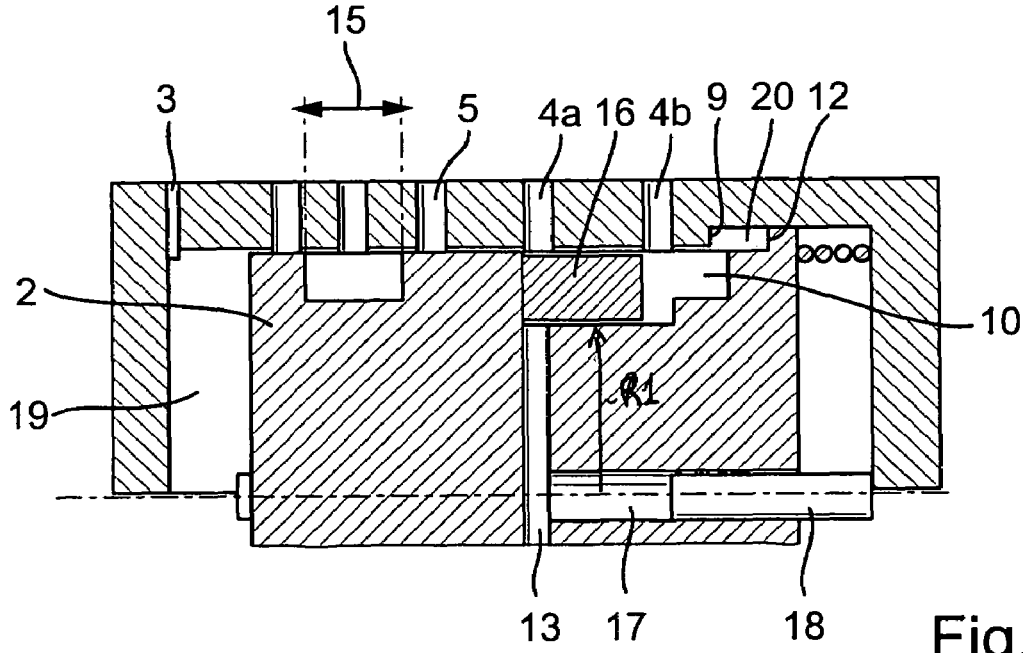
Figure 4:
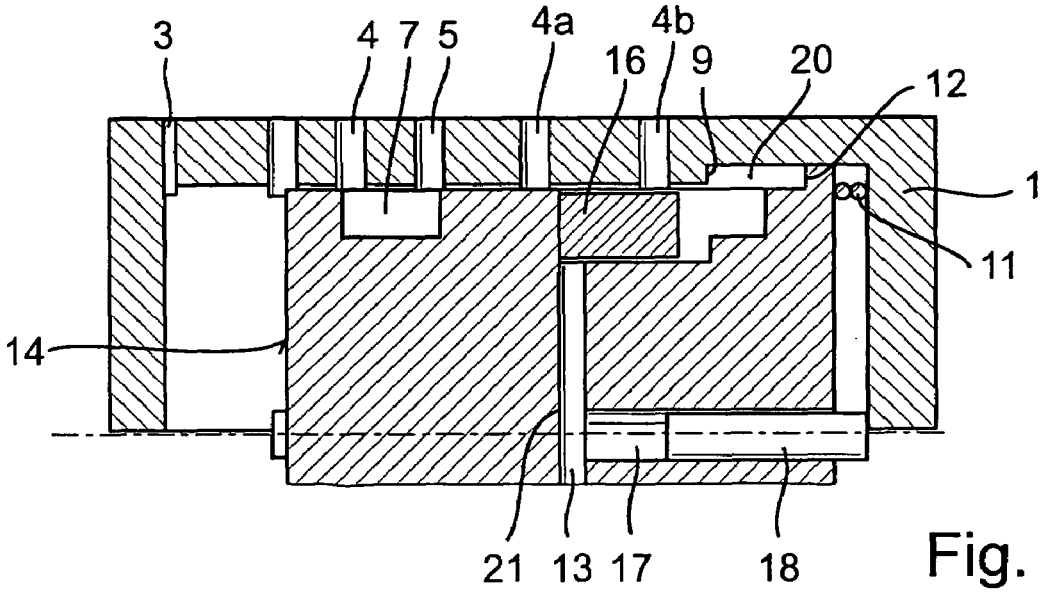

According to FIG. 1, essentially a connection 4 from the pump 40 to the hydraulic line 60 via connection 6 is recognizable, which connection is interrupted by the slider 2 of the valve when the pilot pressure increases, in order to switchover so as to establish a connection between the pump 4 and the reservoir 5. Until the switchover is executed, whereby the hydraulic flow is also redirected, the slider 2 covers a certain area in the valve body in such a way that no link to the two connections may be established in that area, but rather one valve body connection is always closed. This coverage area is technically defined, however, in order to prevent the connection 6 of the hydraulic line 60 connecting with the reservoir 5. The module connected to the valve, whose mode of action is described in greater detail on the basis of FIGS. 2 through 4, is used to meet this technical demand while shortening the time of the switchover process. The schematically depicted spring 11, bore 13, sliding ring 16, and additional connections 4*a* and 4*b* shown in FIG. 1 are described in more detail with respect to FIGS. 2 to 4.

The mode of action of the switchover valve may be seen in FIGS. 2 through 4, which depict the arrangement of the approach according to the present invention.

Valve 8 is made up essentially of a body 1 and a slider 2, which is held in a certain position in part by a pressure spring 11. Body 1, whose wall thickness is reduced on the pressure spring side to form a shoulder, has six bores or connection options for corresponding lines. One connection 3 serves to introduce hydraulic oil to apply a certain pressure, the pilot pressure, to pressure surface 14 of slider 2. The other bores are intended for connections 4, 4*a* and 4*b* to a pump 40, for a connection, which may be an output connection, to a reservoir 5 and for a connection 6 to hydraulic line 60 (FIG. 1).

Slider 2 is provided, at a distance from pressure surface 14, with a circumferential slot 7, whose width is derived from the interval between two adjacent connections plus their diameters. To ensure that slot 7 covers two of the adjacent connections 6, 4, 5 when slider 2 is moved axially, the distance from slot 7 to pressure surface 14 depends on the contact of slider 2 on valve body 1, which results from the contact of return surface 12 (see FIGS. 3 and 4) of slider 2 on stop surface 9 of valve body 1.

Connections 4*a* and 4*b* are provided in body 1 of valve 8 for implementing additional pump connections. To control the connection possibility that either connection 4*a* or connection 4*b* is released, i.e. opened, to the pump, slider 2 has a radial indentation 10 (FIG. 5) that reduces the diameter of slider 2 to a certain diameter, twice the radius R1. This diameter is retained over a certain length in the axial direction, until the original diameter of slider 2 is initially reached again through an adjoining step AS. An additional step, adjoining in continuation of slider 2, whose diameter is greater than the original slider diameter, forms a stop via return surface 12 together with stop 9 of body 1. In addition, slider 2 has a centrally situated through bore 13 in the radial direction, which penetrates indentation 10 at two points in its circumference and touches the latter with its outer wall. In an advantageous manner, the diameter of this bore 13 may be equal to that of connections 4*a* and 4*b*. In addition, slider 2 has an axially centered blind bore 17, which extends from its end on the pressure spring side and meets through bore 13. Positioned in this blind bore is a pin 18, which rests against the inner wall of valve body 1 for centering slider 2. In addition, the two bores 13 and 17 are filled with hydraulic fluid.

The innermost step of indentation 10 receives a sliding ring 16, which is axially movable within the limits of the step, i.e., from the outer wall of through bore 13 to the adjoining step AS. This sliding ring 16 has an outer diameter that is matched to the inside diameter of valve body 1 at this point. The width of the sliding ring 16 is defined by the distance between connections 4*a* and 4*b* plus the diameter of one of these connections 4*a*, 4*b*, both diameters being functionally the same. In addition, the surface of sliding ring 16 is roughened on its outer circumference, so that while it is freely axially movable on slider 2, a certain static friction with the inner wall of body 1 is ensured.

To place sliding ring 16 on the innermost step of indentation 10, it is advantageous either to divide the slider at the point where the subsequent step begins, or to retain the diameter of the innermost step as a shoulder to its end and to provide it with threading. The further stepped part of slider 2, which has a corresponding inner thread, may then be screwed together with the first part. Other possibilities for connecting the two parts are conceivable, such as gluing, welding or the like, which depend on the material chosen for slider 2. A different approach to solving the problem would be offered by dividing sliding ring 16 into at least two parts, for example two semicircles, which would then need to be joined together again after being placed on the innermost step.

The arrangement and design of indentation 10 is of particular importance. If circumferential slot 7 is in the area of valve body 1 where only connection 4 remains open, bore 4*a* should be congruent with through bore 13 (as in FIGS. 3 and 5). As already stated, indentation 10, which is adjacent to the through bore 13 in this representation, has two steps, the width of the innermost step being large enough to cover the two connections 4*a* and 4*b* and the space between them. The adjoining step AS must be wide enough so that it extends beyond the shoulder stop 9 of valve body 1, so that a second pressure chamber 20 (FIGS. 3 and 4) is created in combination with the outermost step in this position of slider 2. The two bores 13 and 17 together form third pressure chamber 21.

According to FIG. 2, slider 2 is in the vicinity of the left internal wall of the body 1 of valve 8. A correspondingly dimensioned spacer centered on the inner wall (or the interaction of surfaces 9 and 12 as shown in FIG. 3) may ensure that slider 2 is always kept at a distance from the inner wall of valve body 1, so that the hydraulic fluid, under a certain pilot pressure, may be introduced into first pressure chamber 19 (See FIG. 3). If the two forces that are acting on the end surfaces of slider 2 are in equilibrium, the latter may take the position shown in FIG. 2; i.e., pump 40 is connected to hydraulic line 6. If the pilot pressure in first pressure chamber 19 rises and with it the force which counteracts the force of pressure spring 11, the equilibrium within the valve is canceled and the hydraulic fluid pressing against pressure surface 14 moves slider 2 in the direction of pressure spring 11. In this axial movement, circumferential slot 7 moves past the area of connection 6 and eventually to solely connect with connection 4. Sliding ring 16, adjacent to its left boundary, is also moved.

At the same time, return surface 12 of slider 2 lifts off of stop surface 9 of valve body 1 (FIG. 3), and hydraulic fluid is able to flow through connection 4*b* into the free space of indentation 10 and into second pressure chamber 20 formed by the two oppositely directed steps of slider 2 and valve body 1. The motion in this direction continues until the switchover process is concluded, i.e., until slot 7 of slider 2 releases, i.e. unblocks, both connections 4 and 5 (FIG. 4).

FIG. 3 shows circumferential slot 7 exceeding coverage area 15. Until the conclusion of the switchover process, it is possible for hydraulic fluid to collect through connection 4*b* in second pressure chamber 20, which at the same time has the advantage that the pressure that has built up upstream from the pump 40 as a result of the closing of a line (through closing of the connection to line 6) may be dissipated again. The hydraulic fluid in second pressure chamber 20 causes sliding ring 16 to continue to retain its position.

If the switchover process is concluded, as may be seen from FIG. 4, so that connections 4 and 5 are linked together, then slider 2 has moved so far in the direction of pressure spring 11 that sliding ring 16 has closed connection 4*b* and at the same time has ceased contact with connection 4*a*. At the same time, the hydraulic fluid in third pressure chamber 21 has simultaneously pressed against pin 18 against the wall of valve body 1, so that a pressure has built up in chamber 21 which is attempting to be dissipated again. At this point sliding ring 16 has reached its right stop (as has slider 2), and connections 4 and 5 are linked together.

If the pilot pressure then drops, as indicated in FIG. 5, slider 2 again moves in the opposite direction. This pressure reduction causes slider 2, guided by pin 18, to be moved back to its starting position. Because of its increased friction, sliding ring 16 initially retains its position on the inner wall of valve body 1. A pressure equalization, initiated by third pressure chamber 21, may now take place through connection 4*a*, which is connected to through bore 13. During this process only slider 2 has moved, and sliding ring 16 remained at its right stop. Circumferential slot 7 is in the coverage area for connection 4 again.

At the same time, the shift of slider 2 with respect to sliding ring 16 in second pressure chamber 20 can caused a pressure to build up which is also attempting to become equalized, and thereby moves sliding ring 16 again to its left stop surface. Connection 4*b* is now open, and the switchover process in this direction may be completed so that the FIG. 2 position may be reached again.

Figure 5:
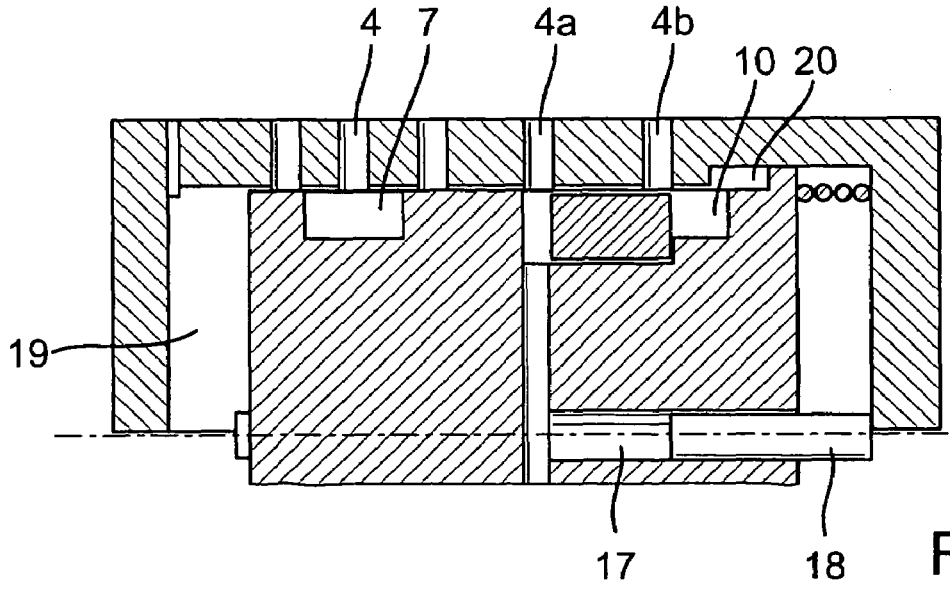

It should be noted that the slider 2 moving from the FIG. 4 to FIG. 5 position can accelerate at one rate, as little friction is present, and then when the step AS hits sliding ring 16 which frictionally engages body 1, sliding ring 16 may accelerate at a different rate.

| List of reference numerals | |
|---|---|
| 1 | Valve body |
| 2 | Slider |
| 3 | Pressure connection |
| 4 | Pump connection |
| 4a | Pump connection |
| 4b | Pump connection |
| 5 | Reservoir connection |
| 6 | Hydraulic line connection |
| 7 | Circumferential slot |
| 8 | Valve |
| 9 | Stop surface |
| 10 | Stepped indentation |
| 11 | Pressure spring |
| 12 | Return surface |
| 13 | Through bore |
| 14 | Pressure surface |
| 15 | Coverage area |
| 16 | Sliding ring |
| 17 | Blind hole |
| 18 | Pin |
| 19 | First pressure chamber |
| 20 | Second pressure chamber |
| 21 | Third pressure chamber |
| 40 | Pump |
| 112 | Piston |
| 113 | Pressure |

What is claimed is:

1. A fluid device comprising:

a pump;

a fluid line;

a reservoir; and a pilot-pressure-dependent three-way valve having a body including a first connection to the pump, a second connection to the fluid line and a third connection to the reservoir, and a first slider element and a second slider element movable in the body so as to fluidly connect the first connection alternately to either second connection or the third connection, the first slider element and the second slider element being movable independently of each other at least during a time interval of a switchover between when the first and second connections are connected and the first and third connections are connected, wherein the body has a first additional connection and a second additional connection to the pump, the first and second additional connections adjoining the first, second and third connections in an axial direction and being spaced apart from the first, second and third connections and from each other.

2. The device as recited in claim 1 wherein the body on a pressure spring side after the second additional connection has a wall thickness reduced in a stepped manner, a resultant radial shoulder surface forming a stop surface for the first slider element.

3. The device as recited in claim 1 wherein the first slider element is provided in a radial direction with a centrally positioned through bore having a diameter is equal to a diameter of the first and second additional connections.

4. The device as recited in claim 3 wherein the first slider element has a slot and a pressure surface, a distance from the through bore to the pressure surface being such that when the slot covers solely the first connection, a fluid connection may be established via the through bore to the first additional connector.

5. The device as recited in 3 wherein the first slider element has, starting from an end on a pressure spring side, a blind hole centered on an axis of the first slider element and reaching to the through bore, and further comprising a pin in the blind hole.

6. The device as recited in claim 5 wherein an end of the pin rests against an inner wall of the valve body and has a length that is less than or equal to that of the blind hole.

7. A fluid device comprising:

a pump;

a fluid line;

a reservoir; and a pilot-pressure-dependent three-way valve having a body including a first connection to the pump, a second connection to the fluid line and a third connection to the reservoir, and a first slider element and a second slider element movable in the body so as to fluidly connect the first connection alternately to either second connection or the third connection, the first slider element and the second slider element being movable independently of each other at least during a time interval of a switchover between when the first and second connections are connected and the first and third connections are connected, wherein the first slider element has a first diameter, and an indentation with a smaller diameter before an end on a pressure spring side, and in a first step and a second additional step in a direction of the end again reaches the first diameter of the first slider element, and has an additional outermost step with a second diameter larger than the first diameter, the second diameter matching an inside diameter of the body.

8. The device as recited in claim 7 wherein a radial ring surface formed by the additional outermost step forms a return surface, the body on a pressure spring side after the second additional connection having a wall thickness reduced in a stepped manner, a resultant radial shoulder surface forming a stop surface for the first slider element, the return surface and the stop surface together limiting a travel of the pressure spring.

9. The device as recited in claim 7 wherein the first slider element is provided in a radial direction with a centrally positioned through bore having a diameter, a width of the innermost first step of the indentation being defined by the distance from an outer wall of the diameter of the through hole to the shoulder of an adjoining second step.

10. The device as recited in claim 9 wherein the body has a first additional connection and a second additional connection to the pump, the first and second additional connections adjoining the first, second and third connections in an axial direction and being spaced apart from the first, second and third connections and from each other, the width of the innermost first step of the indentation equaling the sum of the diameters of the first and second additional connections and the distance between the first and second additional connections.

11. The device as recited in claim 7 wherein the width of the second step of the indentation adjoins that of the innermost first step and extends beyond a stepped reduction of a wall thickness of the valve body when a slot in the first slider element solely covers the first connection.

12. The device as recited in claim 7 wherein on the innermost first step of the indentation, the second slider element, in the form of a sliding ring, is located, the second slider element being axially movable on the innermost first step.

13. The device as recited in claim 12 wherein an outside diameter of the sliding ring corresponds to an inside diameter of the body.

14. The device as recited in claim 12 wherein an outside diameter of the sliding ring forms a friction pairing with an inside diameter of the body.

15. The device as recited in claim 12 wherein an inside diameter of the sliding ring forms a gap together with the smaller diameter.

16. The device as recited in claim 12 wherein the width of the sliding ring is a function of the difference between the width of the innermost first step and a diameter of an additional connection of the body.

17. The device as recited in claim 12 wherein a surface roughness of the outside and inside diameters of the sliding ring is different.

18. The device as recited in claim 17 wherein the roughness of the surface of the outside diameter of the sliding ring is greater than that of the inside diameter.

* * * * *